US010026382B2

(12) United States Patent
Shaheen

(10) Patent No.: US 10,026,382 B2
(45) Date of Patent: Jul. 17, 2018

(54) BRIDGE FOR STRINGED INSTRUMENT

(71) Applicant: Philip Shaheen, Tarshiha (IL)

(72) Inventor: Philip Shaheen, Tarshiha (IL)

( * ) Notice: Subject to any disclaimer, the term of this patent is extended or adjusted under 35 U.S.C. 154(b) by 0 days.

(21) Appl. No.: 15/101,513

(22) PCT Filed: Jan. 14, 2016

(86) PCT No.: PCT/IL2016/050040
§ 371 (c)(1),
(2) Date: Jun. 3, 2016

(87) PCT Pub. No.: WO2016/125136
PCT Pub. Date: Aug. 11, 2016

(65) Prior Publication Data

US 2017/0323622 A1 Nov. 9, 2017

(30) Foreign Application Priority Data

Feb. 2, 2015 (IL) ..... 237060

(51) Int. Cl.
*G10D 3/04* (2006.01)

(52) U.S. Cl.
CPC ..... *G10D 3/04* (2013.01)

(58) Field of Classification Search
CPC ..... G10D 3/04; G10D 13/00
See application file for complete search history.

(56) References Cited

U.S. PATENT DOCUMENTS 4,951,543 A * 8/1990 Cipriani ..... G10D 3/04 84/291
5,052,260 A 10/1991 Cipriani
5,347,905 A * 9/1994 Cipriani ..... G10D 3/04 84/298
5,945,614 A 8/1999 White

* cited by examiner

*Primary Examiner* — Kimberly Lockett
(74) *Attorney, Agent, or Firm* — Law Offices of Steven W. Weinrieb

(57) ABSTRACT

A string instrument comprising an instrument body, a neck, a bridge, and at least one string extending forwardly and rearwardly over the instrument body. The instrument body is topped by a sound table. The bridge may be removably located onto the sound table by virtue of a tension applied to the at least one string.

9 Claims, 10 Drawing Sheets

BRIDGE FOR STRINGED INSTRUMENT

FIELD OF THE DISCLOSURE

Generally disclosed herein is a bridge for string instruments. Henceforth, the term "string instrument" may comprise any musical instrument having at least one string extending approximately in parallel to a sound table and/or soundboard. The bridge may be mounted on the sound table, with at the least one string extending over the bridge. More particularly, the present disclosure is related to a bridge for string instruments which may be removably secured to the sound table.

BACKGROUND OF THE DISCLOSURE

Generally, a string instrument comprises a sound table [also known as 'sound board' and/or 'soundboard'] with at least one string extending generally in parallel thereabove, defining an "up" and "down" direction, with the at least one string extending generally linearly, defining a longitudinal direction. The string extends away from a generally rearwardly-disposed string tail towards a generally forwardly-disposed string head, thus defining a forward-to-rearward direction.

The bridge is intended for supporting the strings on the stringed instrument and to assist in transmitting vibrations thereof to other structural components of the string instrument, comprising, inter alia, the sound table, in an intent to transfer sound to surrounding air. Typically, the bridge is placed generally perpendicularly to the at least one string and the sound table (which are roughly parallel to one another) with tension of the at least one string pressing down on the bridge and thus onto the sound table there beneath.

U.S. Pat. No. 5,945,614 titled "Modular guitar system" to White, Timothy P. recites, inter alia, "An improved, modular guitar system is disclosed and includes a guitar body frame, which has a central member disposed along a longitudinal axis of the body frame and a peripheral rim member defining a peripheral shape of the body frame. The system also includes a separate acoustic grill, which is made up of first and second grill sections that are removably attached to the peripheral rim member of the body frame only. The system also includes a removable guitar neck and headstock assembly, which includes a headstock/string retention mechanism, which allows the guitar to be disassembled without allowing the strings to unravel from the guitar string tuning machines. The system also includes an inflatable acoustic chamber, which is attached to the guitar body frame along the guitar body frame peripheral rim member. The inflatable acoustic chamber includes a membrane communicating with the guitar body acoustic grill sections when the acoustic chamber is inflated."

It would be desirable to have a bridge which may be removably secured to the string instrument, facilitating greater moving/positioning freedom while maintaining, if not improving, sonic characteristics of the string instrument. This may be attained with the subject matter set forth in this disclosure as well as in accordance with the attached claims.

SUMMARY OF THE DISCLOSURE

In the following disclosure, aspects thereof are described and illustrated in conjunction with systems and methods which are meant to be exemplary and illustrative, and not limiting in scope.

The present disclosure is broadly related to a string instrument comprising an instrument body, a neck, a bridge, and at least one string extending forwardly and rearwardly over the bridge defining a longitudinal direction and a transverse direction. The instrument body comprises a longitudinally and transversely extending sound table defining "up" and "down" direction and having a table top facing generally up, and a generally opposing table bottom facing generally down. The bridge is preferably releasably mounted onto the sound board and comprises at least one generally forwardly disposed nose floor facing generally down and at least one generally rearwardly disposed prong top facing generally up. The bridge is disposed between the sound table and the at least one string. With the bridge located onto the sound table, at least one nose floor faces towards the table top, while the at least one prong top faces generally towards the table bottom.

Optionally, when the string instrument is assembled, the at least one string bears down towards a ridge top of the bridge, thus bearing down on the bridge while applying a nose floor-down, prong top-up moment, thereby securing the bridge onto the sound board.

Potentially, the bridge is secured to the sound board only by a tension on the at least one string.

Moreover, the bridge may comprise a plurality of prongs projecting away from a ridge back of the bridge.

Alternatively, the bridge may comprise one continuous prong extending away from the ridge back of the bridge.

Furthermore, at least one transversely extending slot is formed in the sound table, facilitating insertion and/or removal of the at least one prong into and/or out of the instrument body through the sound board.

According to another aspect of the present disclosure, there is provided a bridge for a string instrument, the string instrument comprising at least one generally longitudinally extending string extending over a sound table of an instrument body. The bridge extends generally transversely and comprises at least one nose floor and at least one prong top. With the at least one string not tensioned, the bridge may be removably mounted onto the sound table with the at least one prong top being inserted through at least one slot formed in the sound table, and subsequently rotated, so that an at least one nose floor of the bridge pushes is adjacent a table top of the sound table, and the at least one prong top is adjacent a table bottom of the sound table. Tightening the at least one string wedges the bridge onto the sound table.

In addition to the exemplary aspects and embodiments described, further aspects and embodiments will become apparent by reference to the figures and by study of the following detailed description.

BRIEF DESCRIPTION OF DRAWINGS

Exemplary and/or illustrative embodiments of the present disclosure will be presented herein below in the following figures, by way of example only. The figures are not necessarily to scale, and some features may be exaggerated or minimized and/or roughly shown and/or omitted entirely, to show details of particular components, intending that the present disclosure may become more fully understood from the detailed description and the accompanying schematic figures, wherein.

DETAILED DESCRIPTION OF EXEMPLARY EMBODIMENTS

Figure 1:
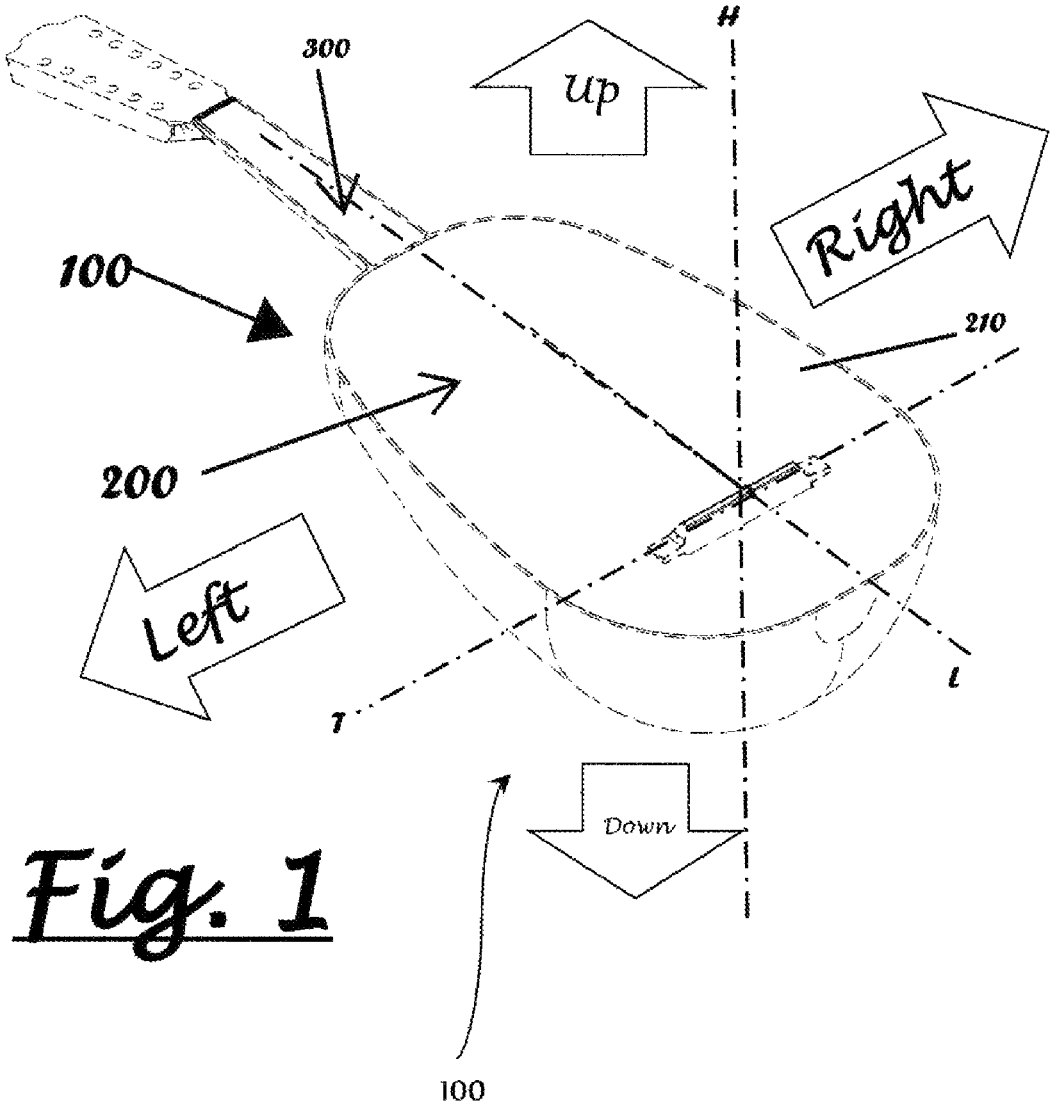
FIG. 1 schematically illustrates a generalized perspective view of an exemplary impression of a in accordance with a first embodiment of the present disclosure.
Figure 2:
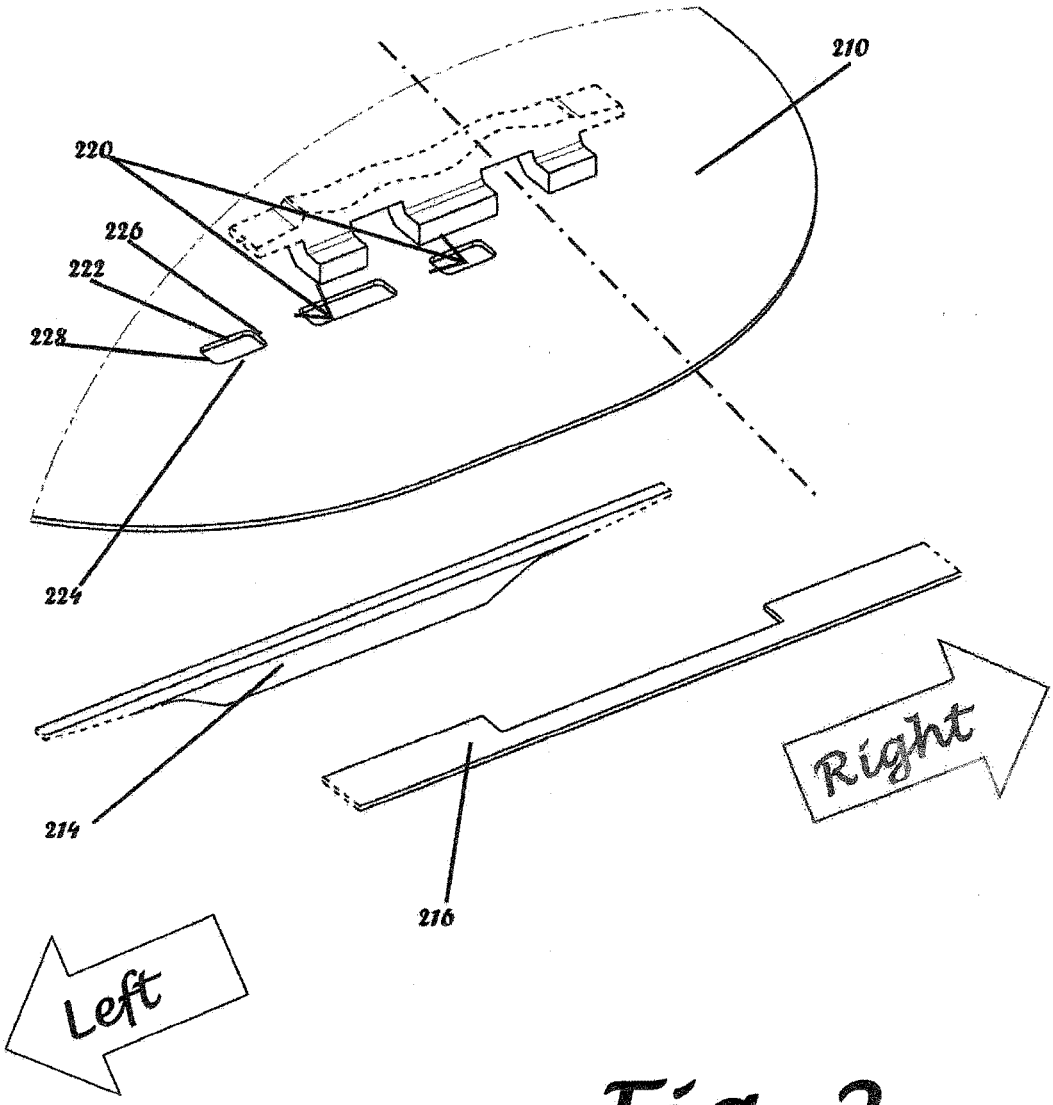
FIG. 2 schematically illustrates a so-called 'exploded' partial perspective view of the first embodiment string instrument schematically illustrated on FIG. 1, illustrating a partial generalized first embodiment sound table and a generalized first embodiment bridge.

Attention is presently drawn to FIG. 1 and FIG. 2. An exemplary first embodiment of a string instrument 100 is schematically illustrated. While this particular embodiment shows a string instrument reminiscent to a guitar, the spirit and scope of the present disclosure relates to other, similar instruments, such as, in solely exemplary manner, Balalaika, Bouzouki, Mandolin, Oud, Tanbur, etc., to name but a few of similar string instruments. Henceforth, elements related to the exemplary first embodiment of the present disclosure will be termed as "first [element]".

The first string instrument 100 generally comprises a first embodiment sound table 200 [also known as 'sound board' and/or 'soundboard'] with an at least one string 300 extending generally above the sound table 200, defining height dimension H extending generally transversely away from a first table top 210 towards a generally opposing table bottom 212 (see FIG. 4) of the first sound table 200. The at least one string 300 extends generally linearly, defining a longitudinal dimension L extending away from a generally rearwardly-disposed string tail 310 (see FIG. 4) towards a generally forwardly-disposed string head [not shown], thus defining a forward-to-rearward direction.

The first sound table 200 further comprises a plurality of table slots 220. Each of the plurality of table slots 220 is roughly rectangular in shape, having a transverse extent generally larger than a longitudinal extent. Each table through-slot 220 extends along the height dimension H generally away from the first table top 210 to terminate the table bottom 212 (See FIG. 4. Each table through-slot 220 comprises a front slot wall 222 and a generally opposing rear slot wall 224. A left slot wall 226 and a generally opposing right slot wall 228 merge with the front slot wall 222 and with the rear slot wall 224. The front, rear, left and right slot walls 222, 224, 226, 228 respectively, connect and merge with the table top 210 and the table bottom 212. The plurality of table slots 220 are disposed spaced apart generally transversely and co-linearly. The table bottom 212 may be provided with braces. Exemplary braces may comprise a front beam 214 and/or a rear pad 216 and/or both, among other optional braces [not shown]. The front beam 214 extends generally transversely and is positioned forwardly of the plurality of table slots 220. The rear pad 216 extends generally transversely and is located rearwardly the plurality of table slots 220.

Figure 3:
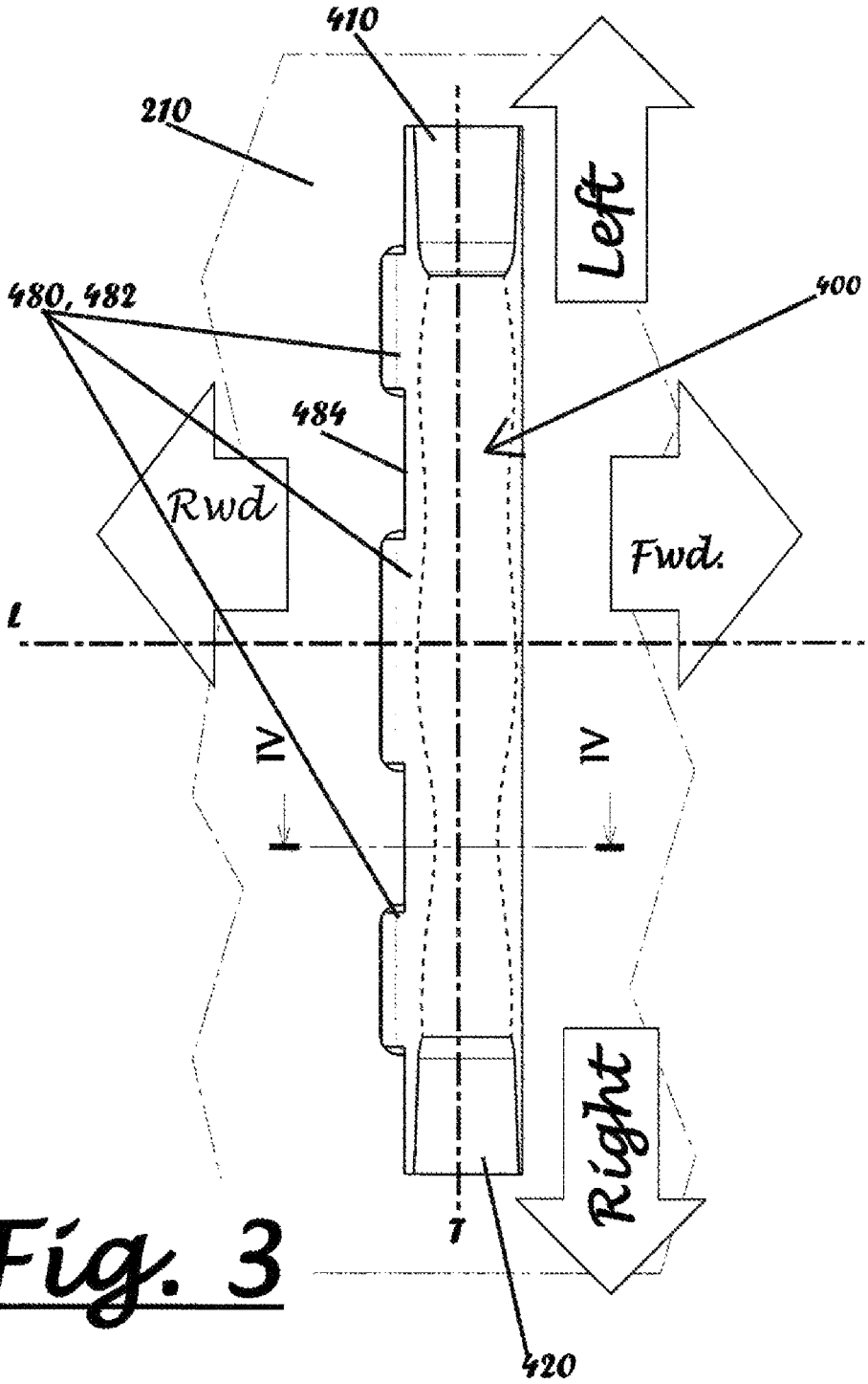
FIG. 3 schematically illustrates a partial top view of the string instrument showing the general first embodiment bridge of FIG. 1.
Figure 4:
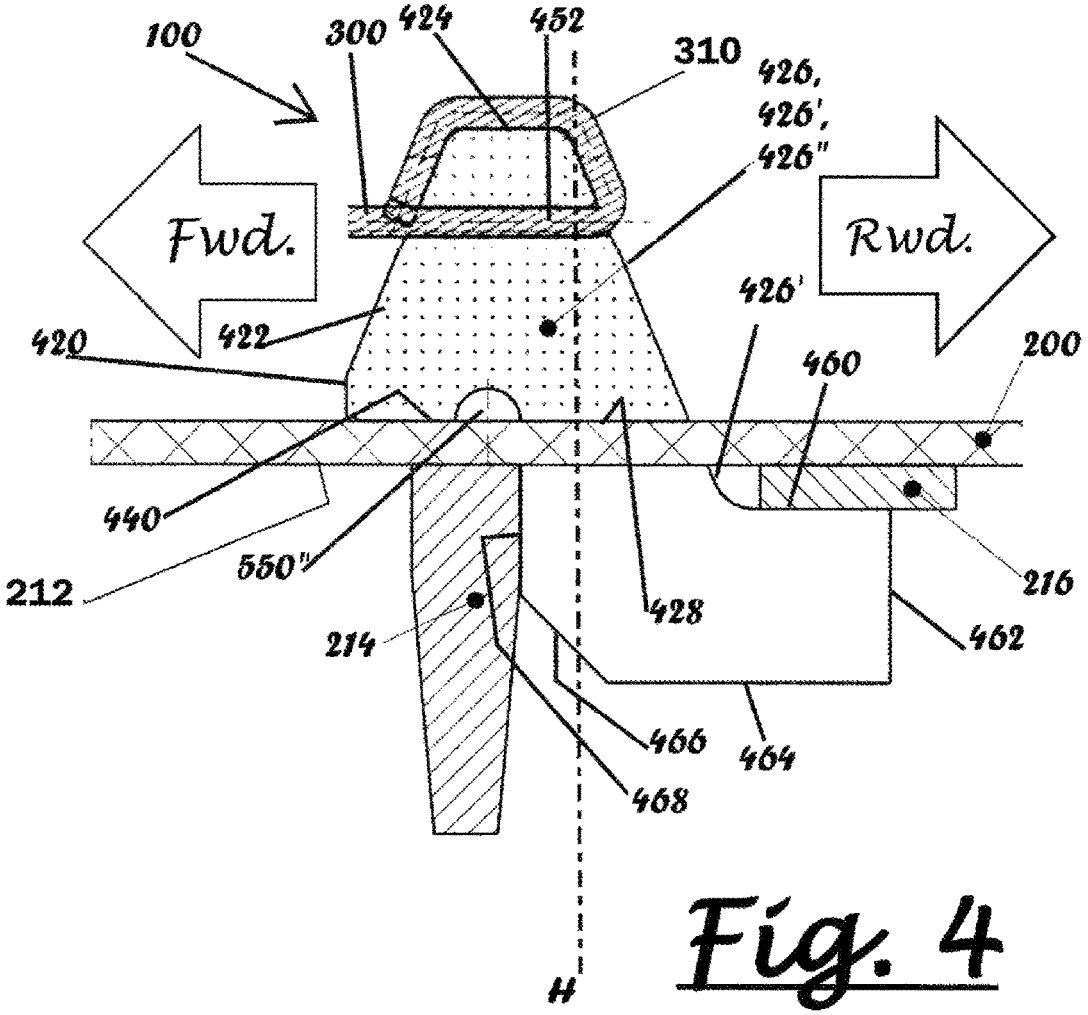
FIG. 4 is a longitudinal cross-sectional view of the general first embodiment bridge, taken along line IV-IV on FIG. 3.

Attention is presently further directed to FIGS. 3 and 4. A first embodiment bridge 400 is generally located between the at least one string 300 (not shown on FIG. 3) and the first table top 210, extending generally transversely to the longitudinal direction L and defining a transverse direction T, and rising along the height direction H [not shown on FIG. 3). The first bridge 400 extends away from a leftwardly-disposed left terminus 410 towards a rightwardly-disposed right terminus 420 and may be removably mounted onto the first table top 210. When viewed from above the first bridge 400 looks like having a generally transversely extending bar-shape. The first bridge 400 may be fashioned by any known or discovered method from any known or discovered substance and/or any combination of substances, be it fabricated, cast, moulded, shaped, laminated, or otherwise combined material.

As may be best seen on FIG. 2 and FIG. 3, the first bridge 400 comprises a plurality of bridge prongs 480, defining a plurality of transversely distributed pronged regions 482 alternating with a plurality of transversely distributed prong-free regions 484, with each of the plurality of pronged regions 482 being flanked by two of the plurality of prong-free regions 484. As there may be similar elements that belong to pronged regions and free regions, similar names and nomenclature will be used, with names and numerals relating to a pronged region will be identified by an appended apostrophe ['] while those belonging to free regions will be annotated by an appended double apostrophe ["].

Attention is additionally directed to FIG. 4. Both pronged regions 482 and prong-free regions 484 of the first bridge 400 comprise a bridge face 420 extending generally along the height dimension H to merge with a ridge front 422 extending generally upwardly therefrom to meet a ridge top 424 extending generally away therefrom and generally transversely thereto to meet a ridge back 426 extending generally transversely to the ridge top 424 and generally away therefrom. Each pronged region 482 comprises a pronged ridge back 426' and each prong-free region 484 comprises a free ridge back 426".

Each free ridge back 426" meets a free ridge floor 428. The free ridge floor 428 extends generally in a direction away from the free ridge back 426" and generally transversely thereto. In this particular embodiment, the free ridge floor 428 extents to meet an optional free ditch 550". The free ditch 550" may extend transversely continually, and/or may be interrupted. A nose floor 440 merges with the free ditch 550" and extend in a direction away therefrom, towards the bridge face 420.

wsEach pronged ridge back 426' extends to merge with a prong top 460. The prong top 460 extends in a direction away from the pronged ridge back 426' and generally transversely thereto, towards a prong rear 462. The prong rear 462 extends in a direction away from the prong top 460 and generally transversely thereto towards a prong bottom 464. The prong bottom 464 extends in a direction away from the prong rear 462 and generally transversely thereto, to merge with a prong wall 468 via a prong transition 466. The prong wall 468 extends away from the prong transition 466 to meet an optional pronged ditch 550'. The pronged ditch 550' may extend transversely continually and co-linearly with the free ditch 550", and/or may be interrupted. A nose floor 440 merges with the pronged ditch 550' and extend in a direction away therefrom, towards the bridge face 420.

The string tail 310 of the at least one string 300 of the first embodiment string instrument 100 passes through a ridge through-hole 452 extending between and opening to the ridge front 442 and the ridge rear 444 generally parallel to the ridge top 446. In the first embodiment string instrument 100, after passing through the ridge through-hole 452, the at least one string 300 is then tied about itself, as is generally known in the art.

Figure 5A:
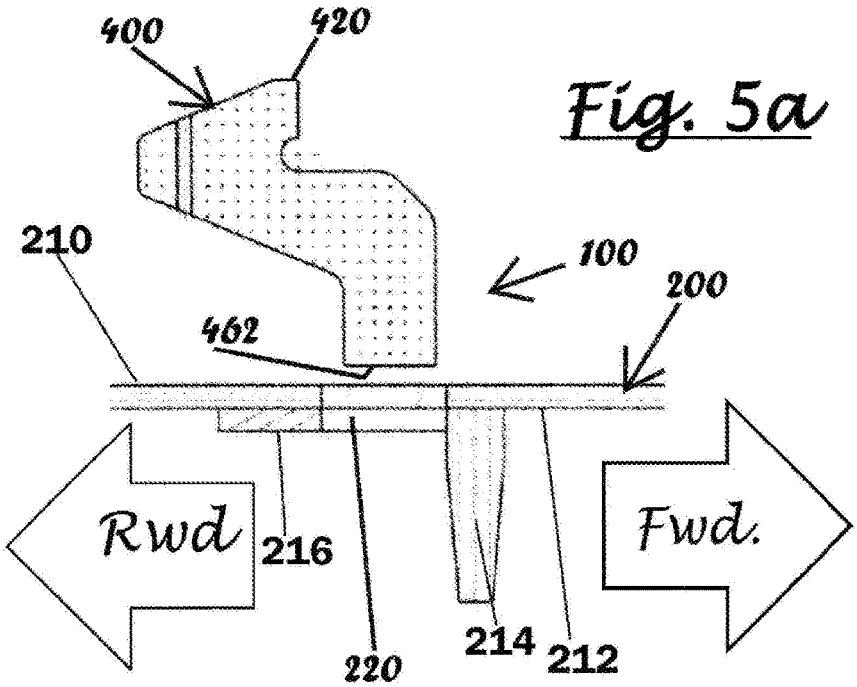
FIG. 5*a* schematically illustrates a longitudinal cross-sectional view through the first embodiment sound table and the first embodiment bridge, in an insertion/removal position of the first embodiment bridge relative to the first embodiment sound table.
Figure 5B:
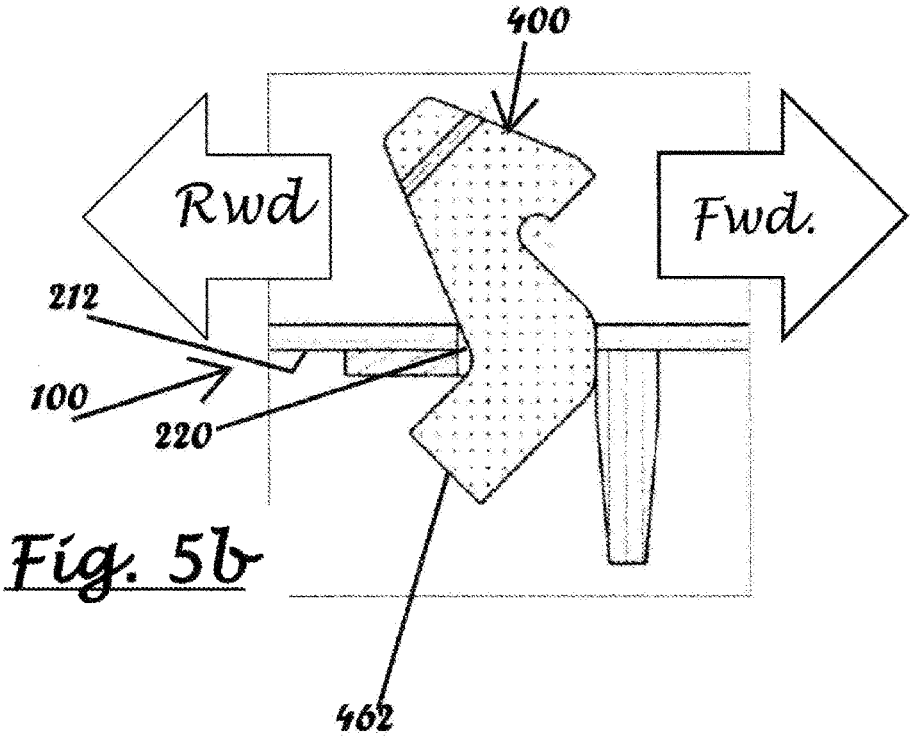
FIG. 5*b* schematically illustrates the longitudinal cross-sectional view through the first embodiment sound table and the first embodiment bridge, in an intermediate position of the first embodiment bridge relative to the first embodiment sound table.
Figure 5C:
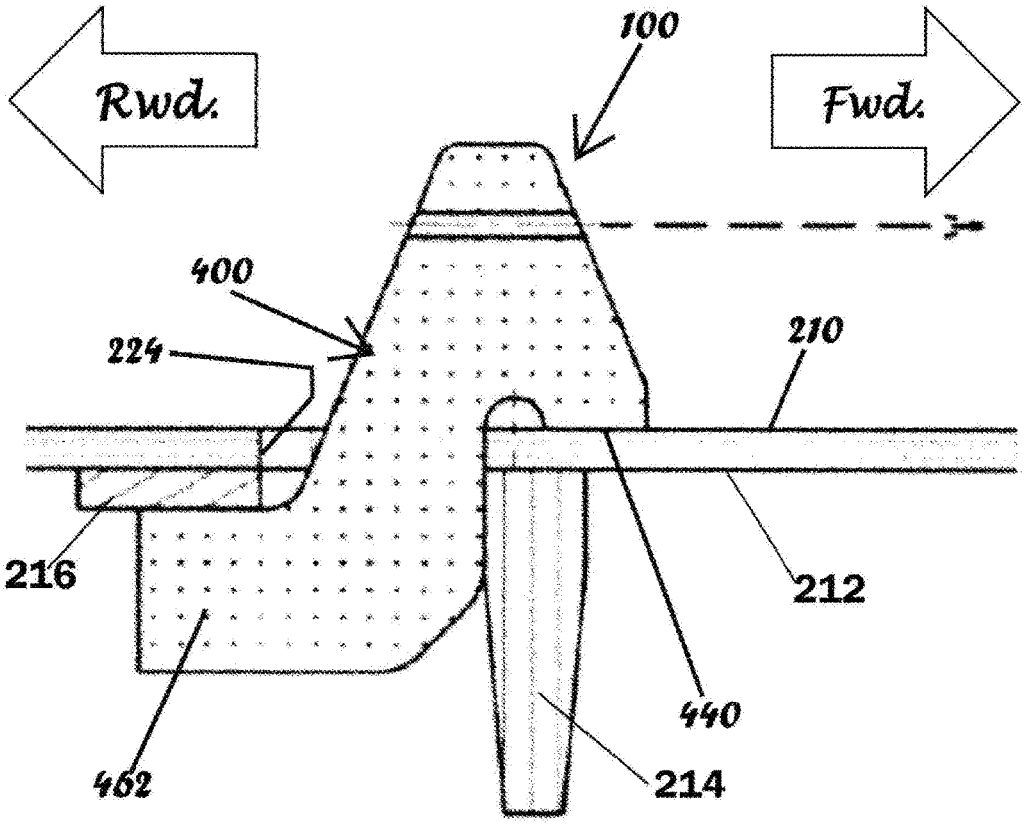
FIG. 5*c* schematically illustrates a longitudinal cross-sectional view through the first embodiment sound table and the first embodiment bridge, in a secured position of the first embodiment bridge relative to the first embodiment sound table.
Figure 6:
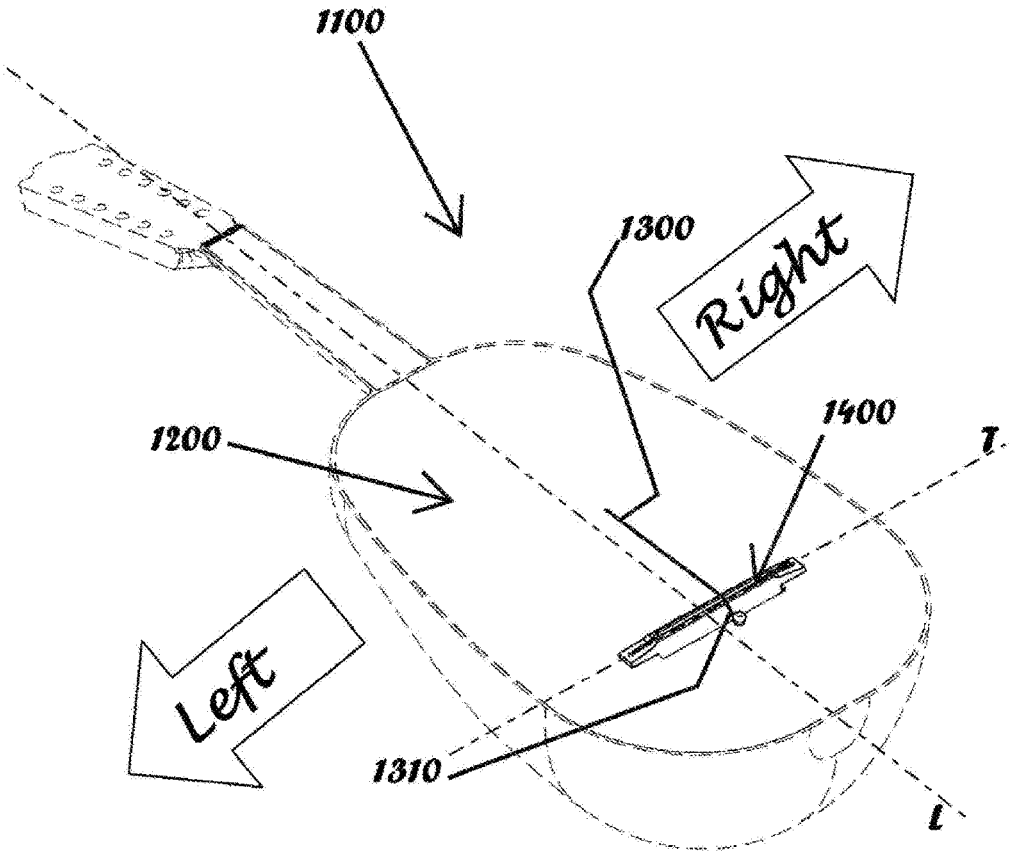
FIG. 6 schematically illustrates a generalized perspective view of an exemplary impression of a string instrument in accordance with a second embodiment of the present disclosure.
Figure 7:
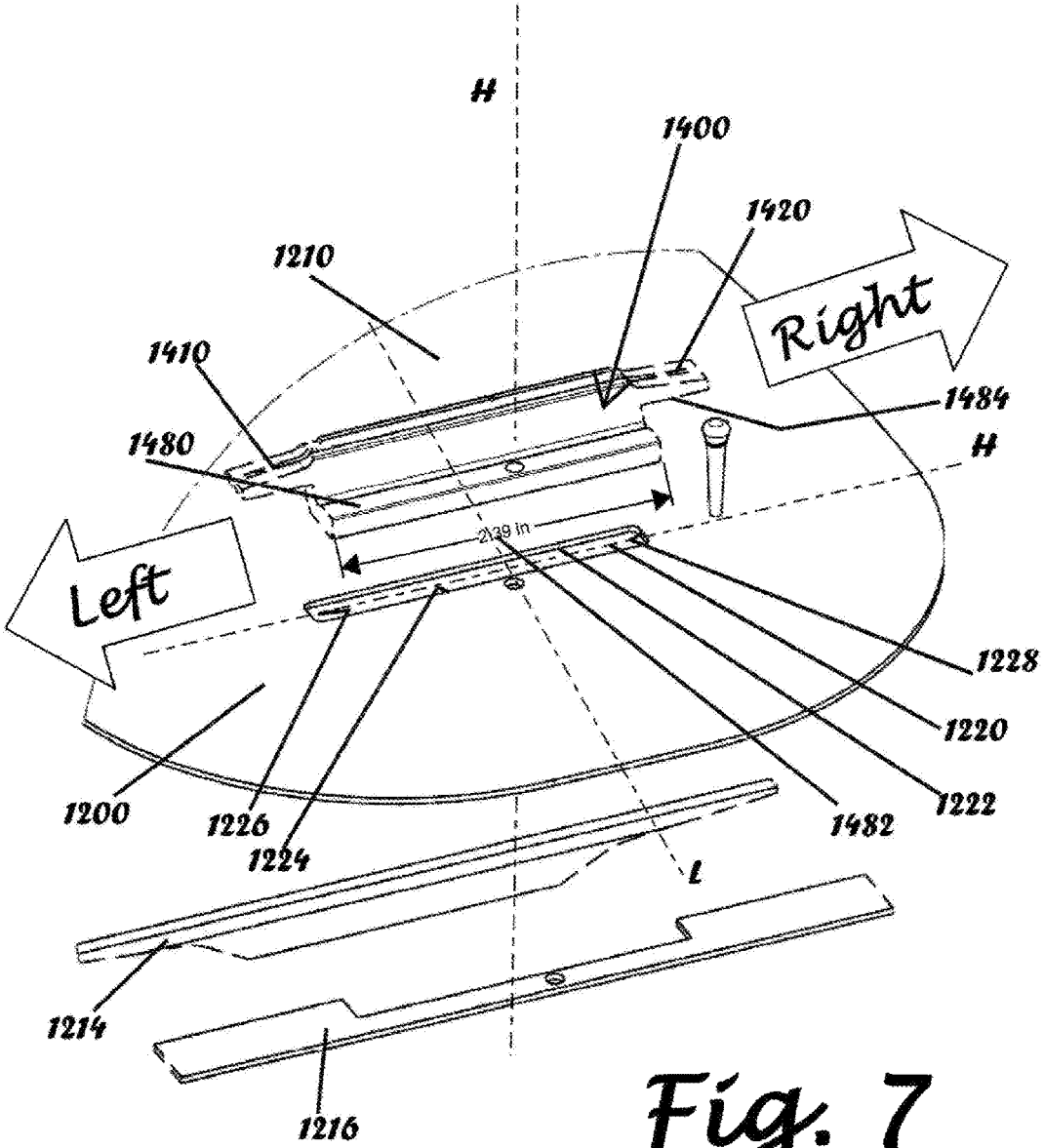
FIG. 7 schematically illustrates a so-called 'exploded' partial perspective view of the second embodiment string instrument schematically illustrated on FIG. 6, illustrating a partial generalized second embodiment sound table and a generalized second embodiment bridge.
Figure 8:
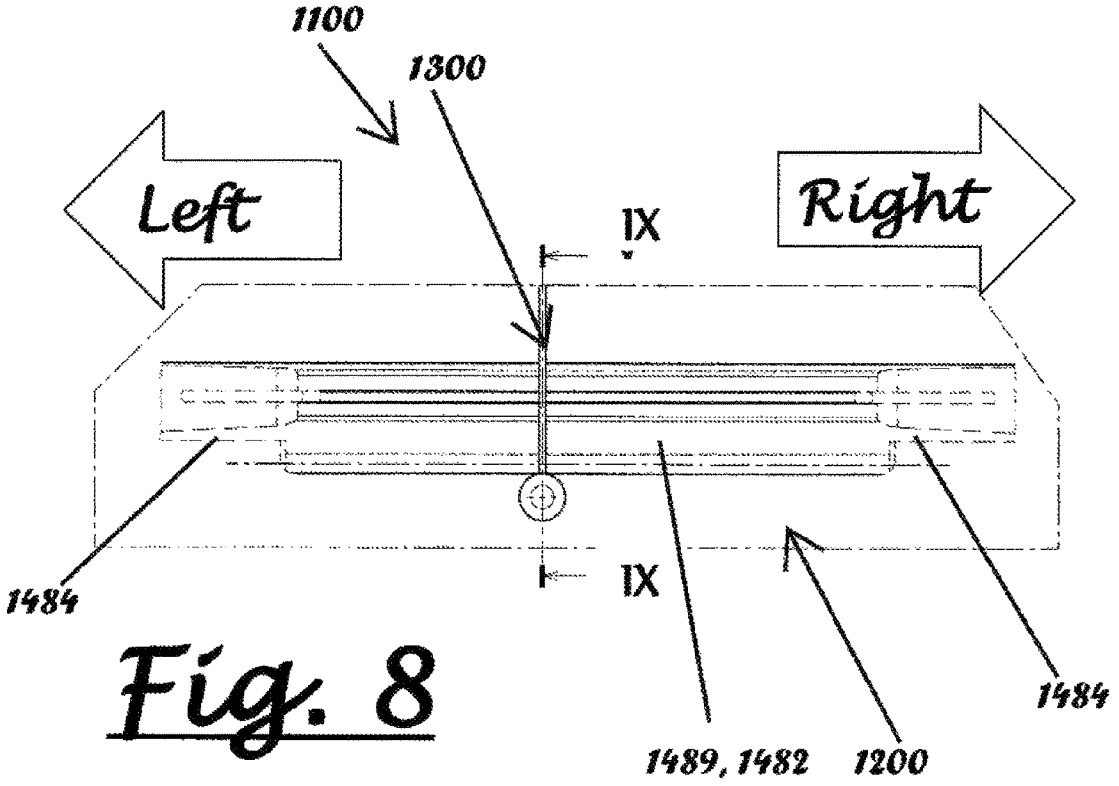
FIG. 8 schematically illustrates a partial top view of the string instrument showing the general second embodiment bridge of FIG. 6.
Figure 9:
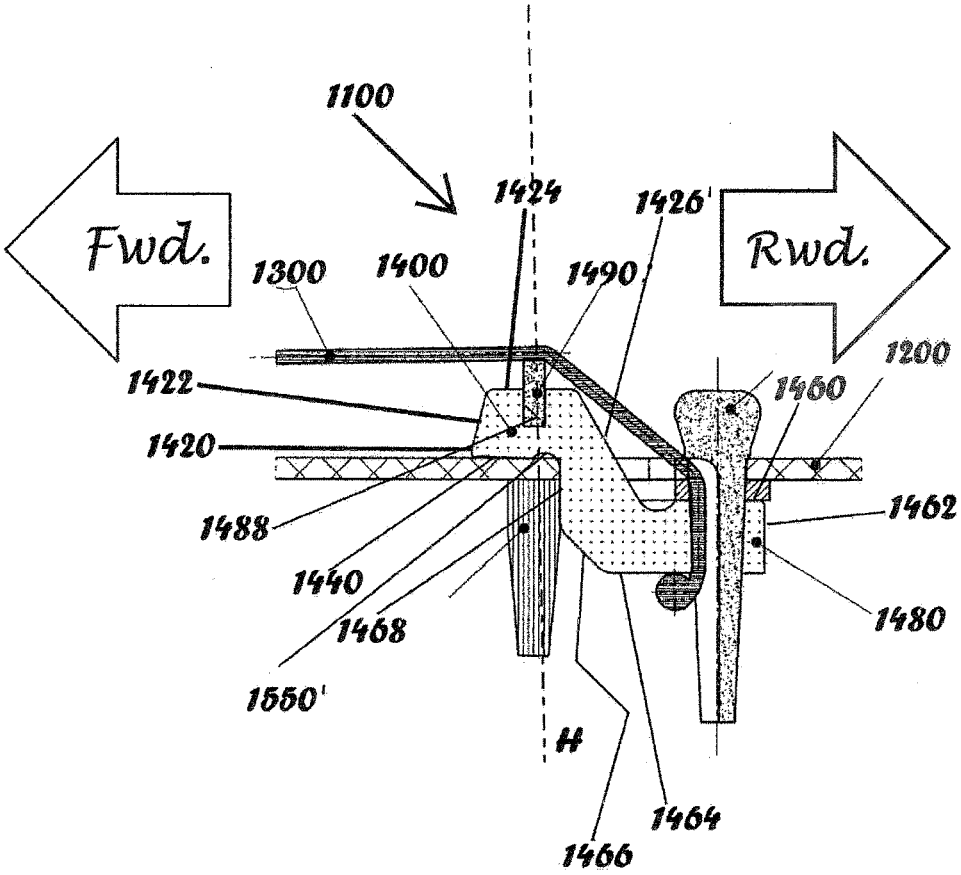
FIG. 9 is a longitudinal cross-sectional view of the general second embodiment bridge, taken along line IX-IX on FIG. 8.

Attention is presently directed to FIGS. 5*a* to 5*c*, showing stages in mounting the bridge 400 onto the sound table 200 of the exemplary-only string instrument 100. While FIG. 5*a* to FIG. 5*c* schematically illustrates the first exemplary embodiment bridge 400 and the first exemplary embodiment sound table 200, other and/or different embodiments should be included in the spirit and scope of the disclosed invention, as claimed. FIG. 5*a* illustrate the first bridge 400 in an insertion stage, wherein the first bridge 400 is rotated with the bridge face 420 pointing upwards and with the prong back 462 facing back, towards the first table top 210. In FIG. 5*b*, there is schematically illustrated an interim stage, wherein the first bridge 400 is positioned so that the prong back 462 is inserted through a corresponding table through-slot 220 to be located below the table bottom 212. In FIG. 5*c*, there is schematically illustrated a final stage, wherein the first bridge 400 is fully rotated, with the prong back 462 located rearwardly of the rear slot wall 224, and with the nose floor 440 rests on the table top 210.

Attention is presently drawn to FIG. 6 to FIG. 9. An exemplary second embodiment of a string instrument 1100 is schematically illustrated. Henceforth, elements related to the exemplary second embodiment of the present disclosure will be termed as "second [element]". Similar elements will be named similar names and numerated with similar numerals, with those elements of the second embodiments have been given reference numerals that are the reference numerals used for the first exemplary embodiment increased by 1000. The second string instrument 1100 generally comprises a second embodiment sound table 1200 [also known as 'sound board' and/or 'soundboard'] with an at least one string 1300 extending generally above the sound table 1200, defining height dimension H extending generally transversely away from a second table top 1210 of the second sound table 1200. The at least one string 1300 extends generally linearly, defining a longitudinal dimension L extending away from a generally rearwardly-disposed string tail 1310 towards a generally forwardly-disposed string head [not shown], thus defining a forward-to-rearward direction.

The second sound table 1200 further comprises a table slot 1220. The table slot 1220 is roughly rectangular in shape, having a transverse extent generally larger than a longitudinal extent. The table through-slot 1220 extends along the height dimension H from away from the second table top 1210 to terminate at a table bottom 1212 generally opposing the second table top 1210. The table through-slot 1220 comprises a front slot wall 1222 and a generally opposing rear slot walk 1224. A left slot wall 1226 and a generally opposing right slot wall 1228 merge with the front slot wall 1222 and with the rear slot wall 1224. The front, rear, left and right slot walls 1222, 1224, 1226, and 1228 respectively, connect and merge with the table top 1210 and the table bottom 1212. The table slot 1220 is disposed generally transversely. The table bottom 1212 may be provided with braces. Exemplary braces may comprise a front beam 1214 and/or a rear pad 1216 and/or both, among other optional braces [not shown]. The front beam 1214 extends generally transversely and is positioned forwardly of the table slot 1220. The rear pad 216 extends generally transversely and is located generally rearwardly of the table slot 1220.

A second embodiment bridge 1400 is generally located between the at least one string 1300 and the second table top 1210, extending generally transversely to the longitudinal direction L and defining a transverse direction T, and rising along the height direction H. The second bridge 1400 extends away from a leftwardly-disposed left terminus 1410 towards a rightwardly-disposed right terminus 1420 and may be removably mounted onto the second table top 1210. When viewed from above the second bridge 1400 looks like having a generally transversely extending bar-shape. The second bridge 1400 may be fashioned by any known or discovered method from any known or discovered suitable substance, be it a monolithic, fabricated, laminated, or otherwise combined material. The second embodiment at least one string 1300 may comprise a string tail 1310, which, in this exemplary—only embodiment, passes over the second embodiment bridge 1400 to be tied to a peg 1590 insert able through the second embodiment sound table 1200.

The second bridge 1400 comprises a bridge prong 1480, defining a pronged region 1482 flanked on either side thereof by a prong-free region 1484. Henceforth, only elements related to the pronged region 1482 will be described and by an appended apostrophe ['']. The pronged region 1482 of the second bridge 1400 comprise a bridge face 1420 extending generally along the height dimension H to merge with a ridge front 1422. The ridge front 1422 extends generally upwardly away from the bridge face 1420 to meet a ridge top 1424. The ridge top 1424 extends generally away from the ridge face 1422 and generally transversely thereto to meet a pronged ridge back 1426'. The pronged ridge back 1426' extends generally transversely to the ridge top 1424 and generally away therefrom. The ridge top 1424 comprises a generally transversely extending niche 1488 accommodating an inserted saddle 1490 over which the at least one string 1300 passes and bears against, as is well known in the art.

The pronged ridge back 1426' extends to merge with a prong top 1460. The prong top 1460 extends in a direction away from the pronged ridge back 1426' and generally transversely thereto, towards a prong rear 1462. The prong rear 1462 extends in a direction away from the prong top 1460 and generally transversely thereto towards a prong bottom 1464. The prong bottom 1464 extends in a direction away from the prong rear 1462 and generally transversely thereto, to merge with a prong wall 1468 via a prong transition 1466. The prong wall 1468 extends away from the prong transition 1466 to meet an optional pronged ditch

1550'. The pronged ditch 1550' may extend transversely continually along the transverse direction T and/or may be interrupted. A nose floor 1440 merges with the pronged ditch 1550' and extend in a direction away therefrom, towards the bridge face 1420. The at least one string 1300 of the second embodiment string instrument 1100 passes over the saddle 1490 to be tied and inserted through the second sound table 1200 by a pin 1510 as is well known in the art.

Throughout the specifications of the present disclosure, the term "comprising" means including but not necessarily to the exclusion of other elements or steps. In other words, the term comprising indicates an open list. Furthermore, all directional references (such as, but not limited to, upper, lower, inner, outer, upward, downward, inwards, outwards, right, left, rightward, leftward, inside, outside, top, bottom, above, below, vertical, horizontal, clockwise, and counter=clockwise, lineal, axial and/or radial, or any other directional and/or similar references) are only used for identification purposes to aid the reader's understanding of illustrative embodiments of the present disclosure, and may not create any limitations, particularly as to the position, orientation, or use unless specifically set forth in the claims. Moreover, all directional references are approximate and should not be interpreted as exact, but rather as describing a general indicator as to an approximate attitude.

Similarly, joinder references (such as, but not limited to, attached, coupled, connected, accommodated, and the like and their derivatives) are to be construed broadly and may include intermediate members between a connection of segments and relative movement between segments. As such, joinder references may not necessarily infer that two segments are directly connected and in fixed relation to each other.

In some instances, components are described with reference to "ends" having a particular characteristic and/or being connected with another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular segment, link, component, part, member or the like. Additionally, all numerical terms, such as, but not limited to, "second", "second", "third", "fourth", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure as set forth in the claims. It is intended that all matter contained in the above description or shown in the accompanying drawings shall be interpreted as illustrative only and not limiting. Changes in detail or structure may be made without departing from the spirit of the present disclosure as defined in the appended claims.

While exemplary embodiments were described and shown in the accompanying drawings, it is to be understood that such embodiments are merely illustrative of and not restrictive on the broad present disclosure, and that the present disclosure may not be limited to the specific constructions and arrangements shown and described, since various, other modifications and/or adaptations may occur to those of ordinary skill in the art. It is to be understood that individual features, which may have been shown or described for the exemplary embodiments, should be understood in the context of functional segments and that such features may be replicated, or be omitted within the scope of the present disclosure and without departing from the spirit of the present disclosure as may be defined in the appended claims. Similar elements that nay have appear edand/or mentioned in association with more than one embodiments should not be taken as instructing and/or implying any limitation on the scope of the present disclosure as may be defined in the appended claims. While some features were shown and/or discussed in the context of one exemplary embodiment, and other features may have been shown and/or discussed in the context of another exemplary embodiment, such features may appear mixedly, or omitted, all without departing from the spirit of the present disclosure as may be defined in the appended claims.

The invention claimed is:

1. A string instrument comprising an instrument body, a neck, a bridge, and at least one string extending forwardly and rearwardly over the bridge thereby defining a longitudinal direction and a transverse direction, the instrument body comprising a longitudinally and transversely extending sound table defining up and down directions and having a table top facing up, and an opposing table bottom facing down, the bridge comprising at least one generally forwardly disposed nose floor facing down and at least one rearwardly disposed prong top facing up so that when the bridge is mounted onto the sound table, by inserting said prong of said bridge through a slot defined within said sound table, and rotated, the at least one nose floor of said bridge faces the table top, while the at least one prong top of said bridge faces the table bottom.

2. The string instrument of claim 1, wherein when the string instrument is assembled, the at least one string bears down towards a ridge top of the bridge, while applying a nose floor down, prong top up moment, thereby securing the bridge onto the sound table.

3. The string instrument of claim 1, wherein the bridge is also secured to the sound table by tension of the at least one string.

4. The string instrument of claim 1, wherein the bridge comprises a plurality of prongs projecting away from a ridge back of the bridge.

5. The string instrument of claim 1, wherein the bridge comprises one continuous prong extending away from a ridge back of the bridge.

6. The string instrument of claim 1, wherein said slot is formed in the sound table so as to facilitate the insertion and removal of the at least one prong into and out of the instrument body through the sound table.

7. A bridge for a string instrument, the string instrument comprising at least one generally longitudinally extending string extending forwardly to rearwardly over a sound table, the bridge extending transversely and comprising at least one generally forwardly disposed nose floor and at least one generally rearwardly disposed prong top, wherein the bridge may be removably mounted onto the sound table with the at least one prong top being inserted through at least one slot formed in the sound table, and rotated so that an at least one nose floor of the bridge is adjacent a table top of the sound table, and the at least one prong top is adjacent a table bottom of the sound table.

8. The bridge of claim 7, wherein applying tension to the at least one string urges the bridge onto the table top while forcing the nose floor towards the table top together with forcing the prong top towards the table bottom, thereby wedging the bridge onto an instrument body portion of the string instrument.

9. The bridge of claim 8, wherein the bridge is additionally secured to the instrument body portion of the string instrument by the tension of the at least one string.

* * * * *